US007108528B2

(12) United States Patent
Wambsganss et al.

(10) Patent No.: US 7,108,528 B2
(45) Date of Patent: Sep. 19, 2006

(54) POWER SUPPLY CONNECTOR

(75) Inventors: Peter Wambsganss, Bexbach (DE); Gareth J. Hackett, Bexbach (DE)

(73) Assignee: RRC Power Solutions GmbH, Homburg (DE)

( * ) Notice: Subject to any disclaimer, the term of this patent is extended or adjusted under 35 U.S.C. 154(b) by 0 days.

(21) Appl. No.: 10/984,550

(22) Filed: Nov. 8, 2004

(65) Prior Publication Data

US 2006/0099858 A1 May 11, 2006

(51) Int. Cl.
*H01R 29/00* (2006.01)

(52) U.S. Cl. ..... 439/188; 200/51.09; 439/668; 439/700

(58) Field of Classification Search ..... 439/188, 439/700, 668–669, 131, 32, 944, 169; 200/51.09
See application file for complete search history.

(56) References Cited

U.S. PATENT DOCUMENTS

| | | | | |
|---|---|---|---|---|
| 4,094,565 | A * | 6/1978 | Parrier et al. | 439/106 |
| 4,295,694 | A * | 10/1981 | Manning | 439/188 |
| 5,347,211 | A | 9/1994 | Jakubowski | 323/351 |
| 5,479,331 | A | 12/1995 | Lenni | 363/21.08 |
| 5,601,441 | A * | 2/1997 | Weinstein et al. | 439/188 |
| 5,636,110 | A | 6/1997 | Lanni | 363/21.08 |
| 5,838,554 | A | 11/1998 | Lanni | 363/141 |
| 5,949,213 | A | 9/1999 | Lanni | 320/106 |
| 5,959,849 | A | 9/1999 | Batarseh et al. | 363/16 |
| 6,091,611 | A | 7/2000 | Lanni | 363/79 |
| 6,172,884 | B1 | 1/2001 | Lanni | 363/21.05 |
| 6,266,261 | B1 | 7/2001 | Lanni | 363/144 |
| 6,643,158 | B1 | 11/2003 | McDonald et al. | 363/142 |
| 6,650,560 | B1 | 11/2003 | MacDonald et al. | 363/142 |
| 2003/0042881 | A1 | 3/2003 | Lanni | 323/297 |
| 2003/0128020 | A1 | 7/2003 | Lanni | 323/297 |
| 2003/0132668 | A1 | 7/2003 | Lanni | 307/38 |

FOREIGN PATENT DOCUMENTS

| | | |
|---|---|---|
| JP | WO91/17590 | * 11/1991 |

* cited by examiner

*Primary Examiner*—Michael C. Zarroli
(74) *Attorney, Agent, or Firm*—Knobbe, Martens, Olson & Bear, LLP.

(57) ABSTRACT

A power supply connector including a spring loaded member that allows a connector to engage various power receptacles. This engagement of the connector and the power receptacle may reduce a contact resistance between the two components and heat dissipation associated therewith. Thus, the power supply connector reduces the risk of damage to the power supply due to heat dissipation in the power receptacle, power supply connector, or other portion of the power supply.

14 Claims, 3 Drawing Sheets

POWER SUPPLY CONNECTOR

RELATED APPLICATIONS

This application is related to, and hereby incorporates by reference the entire disclosure of each of the following commonly owned U.S. patent applications, each filed on even date herewith: (1) U.S. patent application Ser. No. 10/984,551, titled "Temperature Sensor for Power Supply, "(2) U.S. patent application Ser. No. 10/984,695, titled "Power Supply Configured to Detect a Power Source," and (3) U.S. patent application Ser. No. 10/984,552, titled "Microcontroller Controlled Power Supply."

BACKGROUND OF THE INVENTION

1. Field of the Invention

This invention relates to power supplies and, more specifically, to a power supply that includes a connector configured to disable power flow until the connector is properly engaged with a power source.

2. Description of the Related Art

In order to power many electronic devices, such as household appliances, power supply configured for coupling with an external power source. External power sources may include wall outlets, cigarette lighters in automobiles or other vehicles, and in seat power delivery systems in aircraft. For many types of power sources, the mechanical configuration of a connection portion of the power source is standardized. Thus, power supply manufacturers may develop power supplies according to the applicable standard for a particular type of power source and have a reasonable assurance that the power supply will be compatible with that type of power source.

Vehicle cigarette lighters are commonly used to access the power source of a vehicle's electrical power, which generally comprises a battery and alternator, for example. The receptacle of a vehicle cigarette lighter located in an automobile, water vehicle, or other recreational vehicle, for example, (referred to herein generally as a "vehicle receptacle") is standardized so that manufacturers may produce power supplies for various electronic devices that may be powered via the vehicle receptacle. However, some vehicles are not in compliance with the standardized vehicle receptacle specifications. Thus, power supplies having standardized vehicle connectors may not properly engage with these out of specification vehicle receptacles. If a connector is incompletely contacting the vehicle receptacle, there is a possibility for an increase of contact resistance between the connector and the receptacle, and a corresponding increase in heat dissipation at the point of increased contact resistance. This increase in heat dissipation may be absorbed by the vehicle connector and may cause melting of components in the connector or the connector housing. In addition, power delivery to the power supply may be interrupted if the connection with the vehicle receptacle is not stable and the electronic device powered by the power supply may be damaged. Accordingly, systems and methods for enhancing a connector's ability to engage vehicle receptacles are desired. In addition, systems and methods for preventing damage to power supplies due to incomplete or improper connections with vehicle receptacles are desired.

SUMMARY OF THE INVENTION

In one embodiment, in order to prevent excessive heat dissipation in a power supply connector, the power supply connector is configured to mechanically disconnect the power source from the power supply if a satisfactory connection with the power source is not achieved. In another embodiment, the power supply is configured to monitor a contact resistance between the power supply connector and the power source and disable the power supply, or reduce a power signal transmitted from the power supply, if the contact resistance, or temperature of the connector, exceeds a predetermined threshold.

In one embodiment, a connector configured to engagingly mate with a power receptacle of a power source comprises an electrically conductive shaft having a longitudinal axis, the shaft being moveable within the connector along the longitudinal axis and configured to contact the power receptacle, an isolation ring protruding from an outer surface of the shaft, wherein the isolation ring comprises an electrically insulative material, and an electrically conductive housing electrically coupled to a power supply, the housing comprising one or more electrically conductive fingers that are resiliently biased towards the longitudinal axis, wherein the shaft is moveable relative to the housing.

In another embodiment, a method of activating a power supply to deliver power from a power source comprises inserting a connector of the power supply into a power receptacle so that a force is applied to a shaft of the connector, in response to the force applied to the shaft of the connector, moving the shaft inward towards a body of the connector thereby causing a conducting finger of the connector to be moved from contact with an insulative portion of the shaft to contact a conductive portion of the shaft, transferring power from the power receptacle to the shaft, transferring power from the shaft to the conducting finger, and transferring power from the conducing finger to the power supply.

In another embodiment, a method of disabling power delivered from a power source to a power supply comprises engaging a connector portion of the power supply with a receptacle portion of the power source, changing a position of a the connector of the power supply so that a conducting finger of the connector is moved from contact with a conductive portion of the connector to contact an insulative portion of the connector, and blocking transfer of power from the power source to the power supply due to the contact of the conducting finger with the insulative portion of the connector.

In another embodiment, a system for disabling power delivered from a power source to a power supply comprises means for engaging a connector portion of the power supply with a receptacle portion of the power source, means for changing a position of the connector so that a conducting finger of the connector is moved from contact with a conductive portion of the connector to contact an insulative portion of the connector, and means for blocking transfer of power from the power source to the power supply due to the contact of the conducting finger with the insulative portion of the connector.

In another embodiment, a method of reducing a contact resistance between a power receptacle and a power supply connector comprises inserting the power supply connector into the power receptacle so that a shaft of the power supply connector contacts a portion of the power receptacle, engaging the power supply connector with the power receptacle so that the shaft is moved within the power supply connector, and creating an electrically conductive path through the power supply connector in response to movement of the shaft at least a predetermined distance within the power supply connector.

BRIEF DESCRIPTION OF THE DRAWINGS

These and other objects and features of the invention will become more apparent from the following description and appended claims taken in conjunction with the following drawings, wherein like reference numbers indicate identical or functionally similar elements.

DETAILED DESCRIPTION OF THE PREFERRED EMBODIMENT

The following is a detailed description of embodiments of the invention. However, the invention can be embodied in a multitude of different ways as defined by the claims. The invention is more general than the embodiments that are explicitly described, and accordingly, is not limited by the specific embodiments.

Figure 1:
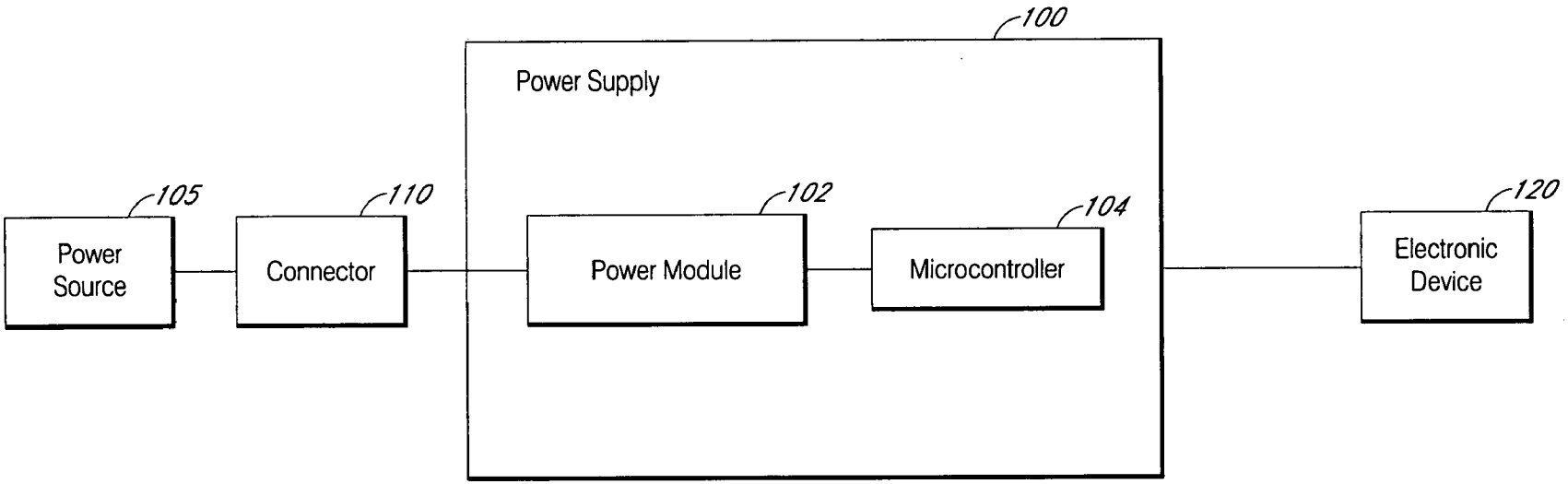
FIG. 1 is a block diagram of a power supply coupled to an electronic device via a changeable connector.

FIG. 1 is a block diagram of a power supply 100 coupled to an electronic device 120 and to a power source 105 via a changeable connector 110 (or simply "connector 110"). In the embodiment of FIG. 1, the electronic device 120 is any type of device that may be powered by an AC or DC power signal. The electronic device 120 may comprise, for example, a household appliance, a stereo component, a computing device, or any other electronic component. In one embodiment, the power source 105 comprises a cigarette lighter receptacle (also referred to herein as a "vehicle receptacle") configured to engage the connector 110, along with the power components coupled to the cigarette lighter, such as the battery and alternator, for example.

The connector 110 is mechanically shaped to be coupled with the power source 105. In one embodiment, the connector 110 comprises a plug having one or more positive and negative leads exposed, wherein the plug may be inserted into a socket, or receptacle, of the power source 105. In one embodiment, the connector 110 is changeable, such that the connector 110 may be configured to couple with either an in-seat power source receptacle in an aircraft or a vehicle receptacle.

In the embodiment of FIG. 1, the power supply 100 comprises a power module 102 and a microcontroller 104. The power module 102 comprises the power delivery components that are configured to generate and supply the voltage to the electronic device 120. The microcontroller 104 is advantageously coupled to the power module 102 and is configured to control the output voltage level from the power module 102. In one embodiment, the coupling of the microcontroller 104 to the power module 102 is via one or more amplifiers, diodes, and other electronic components. Those of skill in the art will recognize that various components may be used in the power module 102 to transform and/or convert power from a power source. The systems and methods described herein expressly contemplate the use of any suitable components in the power module 102. For a more detailed description of the control of a power supply by a microcontroller, refer to commonly owned U.S. patent application Ser. No. 10/984,552, titled "Microprocessor Controlled Power Supply," filed on even date herewith, which is hereby incorporated by reference in its entirety.

Figure 2A:
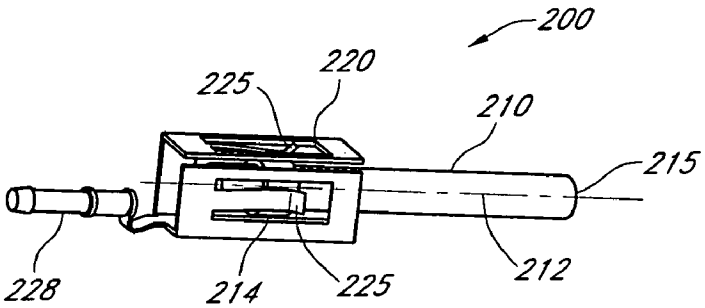
FIGS. 2A and 2B are illustrations of an exemplary plug of a power supply that is configured to engage with a vehicle receptacle.
Figure 2B:
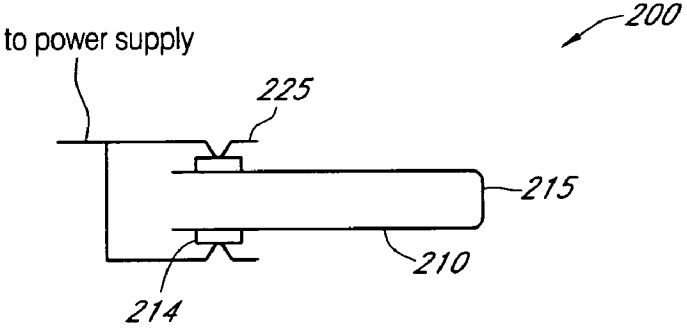

FIGS. 2A and 2B are illustrations of a plug 200 of a power supply that is configured to be inserted into a power receptacle. The exemplary plug 200 is coupled to the power supply 100 and is configured to engage with a power source, such as via a cigarette lighter in a vehicle or an in seat power delivery system in an aircraft. FIG. 2A is an elevated side perspective view of a plug 200 in a quiescent position and FIG. 2B is a cross-sectional side view of the plug 200 in the quiescent position. In the quiescent position, the plug 200 does not transfer power from a power source to the power supply. In an active position, discussed below with reference to FIGS. 3A and 3B, the plug 200 is configured to transfer power from a power source to the power supply.

The plug 200 comprises a shaft 210 having a tip 215 on one end for contacting a power delivery portion of a power source, such as an electrical contact of a power receptacle, which may be, for example, a vehicle receptacle. However, the receptacle could be any other type, such as an in seat power delivery system in an aircraft or a power outlet in a fixed structure. The shaft includes a longitudinal axis 212 extending through a center of the shaft 210. The shaft 210, including the tip 215, is electrically conductive and is configured to mechanically contact the power receptacle.

The plug 200 further comprises a housing 220 comprising one or more resilient fingers 225 that are biased towards the longitudinal axis. The resilient fingers 225 are electrically conductive and configured to exert an inward force towards the longitudinal axis 215 of the shaft 210. The housing includes a power delivery member 228 configured to deliver power to the power supply. The resilient fingers 225 are in electrical contact with the power delivery member 228 so that power delivered to the resilient fingers 225 is transferred to the power delivery member 228. In operation, power is delivered from the power source to the shaft 210, to one or more of the resilient fingers 225, to the power delivery member 228, and to the power supply.

Advantageously, the plug 200 includes features requiring that the plug 200 is properly inserted into a power receptacle before power is transferred from the power source to the power delivery member 228 via the plug 200. In particular, the plug 200 comprises an isolation ring 214 that surrounds a portion of the shaft 210 and is mechanically connected to the plug 200. The isolation ring 214 comprises an electrical insulator, such that electrical current does not pass through the isolation ring 214. In the quiescent state of the plug 200 illustrated in FIGS. 2A and 2B, the resilient fingers 225 contact the isolation ring 214 and are not in contact with a conductive portion of the shaft 210. Accordingly, in this quiescent state, the housing 220 is electrically isolated from the shaft 210 and power is not transferred from the power source to the power delivery member 228.

Figure 3A:
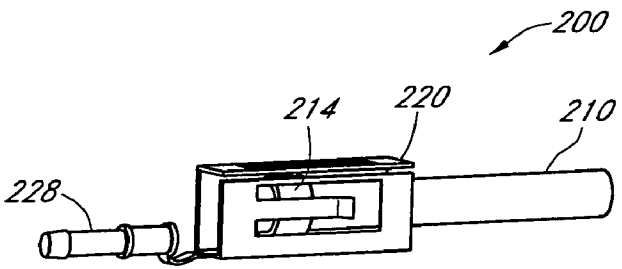
FIGS. 3A and 3B are illustrations of the plug of a power supply that is configured to be inserted into a power receptacle.
Figure 3B:
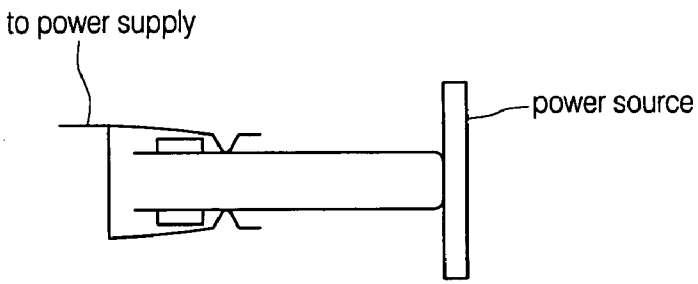

FIGS. 3A and 3B are illustrations of the plug 200 of a power supply that is configured to be inserted into a power receptacle. In particular, FIG. 2A is an elevated side perspective view of a plug 200 in an active position, wherein in the active position power delivered to the shaft 210 is transferred to the power delivery member 228. FIG. 3B is a cross-sectional side view of the plug 200 in the active position. As shown in FIGS. 3A and 3B, the shaft 200 has been moved towards the power delivery member 228 of the housing 220. In one embodiment, the shaft 200 is spring loaded within the housing 220 so that by applying a force to the tip 215, the shaft 200 is moved towards the power delivery member 228. As the shaft 200 is moved inward, the isolation ring 214 is also moved with reference to the resilient fingers 225. Due to the shape of the resilient fingers 225, when the isolation ring 214 has moved inward to a position such as illustrated in FIGS. 3A and 3B, the resilient fingers 225 mechanically contact the conductive portion of the shaft 210 and any power delivered to the shaft 210 is transferred through the resilient fingers 225 and housing 220 to the power delivery member 228. Thus, power is delivered to the power supply when the shaft 200 has a sufficient force applied to move the isolation ring 214 so that the resilient fingers 225 contact the shaft 210. This force may be delivered by a user continuing to push the plug into a vehicle receptacle after the shaft has contacted a surface of the vehicle receptacle.

In one embodiment, after the plug 200 is removed from the power receptacle, the shaft 210 is pushed along the longitudinal axis 215 away from the power delivery member 228. When the shaft 210 returns to a position such that the isolation ring 214 is again in contact with the one or more resilient fingers 225, the plug 200 is again in it's quiescent state. Thus, each time the plug 200 is inserted into a power receptacle, the shaft 210 must be moved in order to put the plug 200 into an active state.

The design of the above described plug reduces the risk of the plug 200 generating excessive heat that can be caused by an incomplete connection with the power receptacle. For example, some vehicle cigarette lighter power receptacles are shallower than standard power receptacles. Thus, a power supply plug designed for use in standard power receptacles may not have a long enough shaft to electrically connect to a power delivery receptacle, thus providing a potential for increased contact resistance and the heat dissipation that results from the additional contact resistance. In addition, the power supply plug may be inserted into a receptacle so that the shaft is incompletely contacting the power source, thus creating a potential for heat generation in the plug, due to an increase in contact, or crossover, resistance, and possible melting of components in the plug. According to the embodiment described above, plug 200 is in a quiescent mode until the plug is inserted a predetermined distance into the power receptacle. In one embodiment, this predetermined distance is the distance that is determined to be necessary to ensure that the plug 200 is properly contacting the power receptacle of any known power receptacle.

Figure 4:
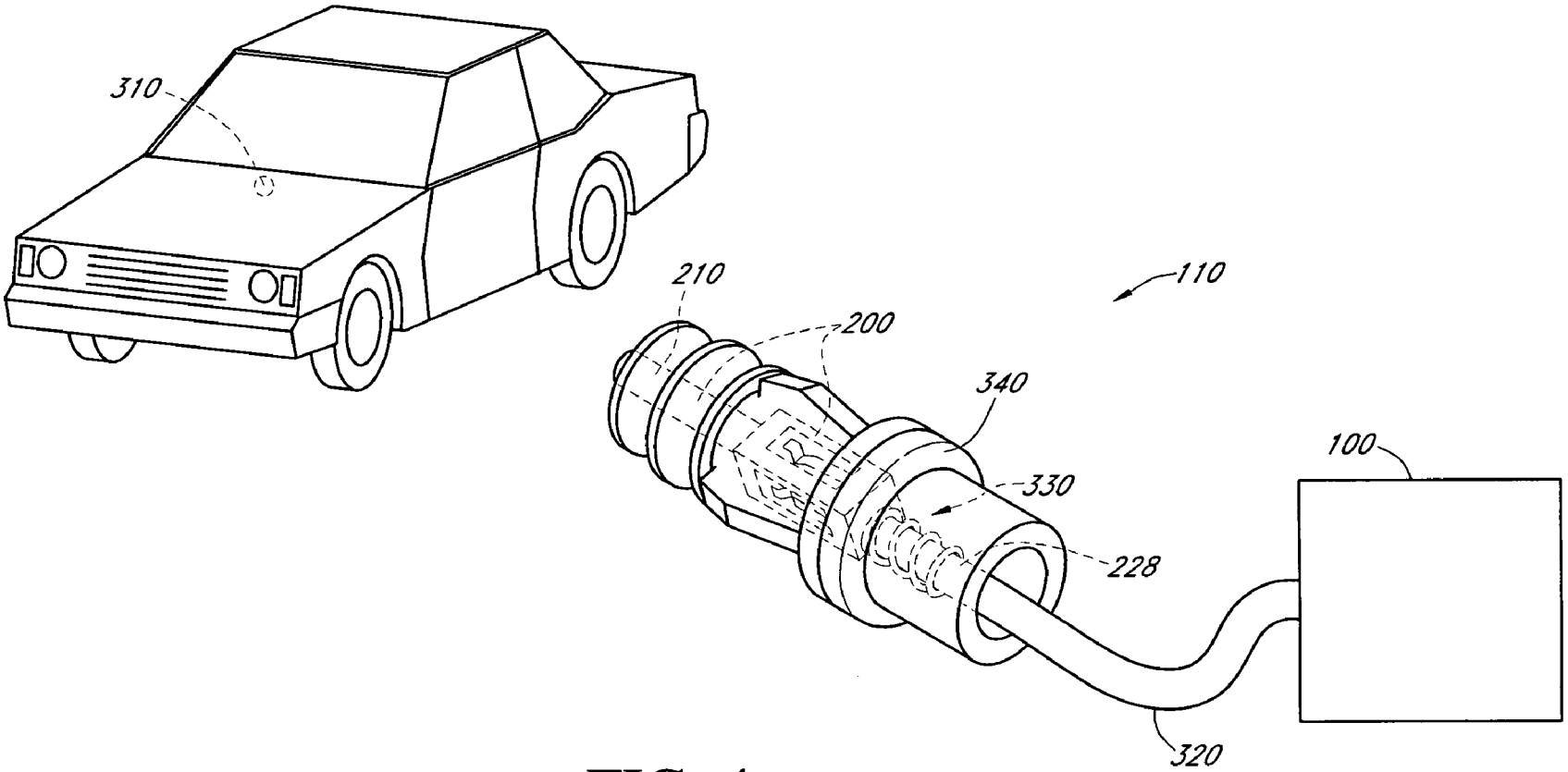
FIG. 4 is a perspective view of a connector including the plug (FIG. 2) configured to be inserted in vehicle receptacle.

FIG. 4 is a perspective view of a connector 110 including plug 200 (FIG. 2) configured to be inserted in vehicle receptacle 310. As shown in FIG. 4, a power delivery member 228 is coupled to the power supply 100 via an electrical cable 320. FIG. 4 also illustrates a spring 330 configured to provide a force on the shaft 210 (FIG. 2) of the plug 200.

Specific parts, shapes, materials, functions and modules have been set forth, herein. However, a skilled technologist will realize that there are many ways to fabricate the system of the present invention, and that there are many parts, components, modules or functions that may be substituted for those listed above. While the above detailed description has shown, described, and pointed out the fundamental novel features of the invention as applied to various embodiments, it will be understood that various omissions, substitutions, and changes in the form and details of the components illustrated may be made by those skilled in the art, without departing from the spirit or essential characteristics of the invention.

What is claimed is:

1. A connector configured to engagingly mate with a power receptacle of a power source, the connector comprising:

an electrically conductive shaft having a longitudinal axis, the shaft being moveable within the connector along the longitudinal axis and configured to contact the power receptacle;

an isolation ring protruding from an outer surface of the shaft, wherein the isolation ring comprises an electrically insulative material; and an electrically conductive housing electrically coupled to a power supply, the housing comprising one or more electrically conductive fingers that are resiliently biased towards the longitudinal axis, wherein the shaft is moveable relative to the housing.

2. The connector of claim 1, wherein, in a quiescent position the resilient fingers contact the isolation ring such that power from the power source is not transferred to the power supply.

3. The connector of claim 1, wherein when the shaft is moved along the longitudinal axis in a first direction, one or more of the resilient fingers contact the shaft and power is transferred from the power source to the power supply.

4. The connector of claim 1, wherein a force exerted by the shaft being pressed against the receptacle causes the shaft to move in the first direction.

5. The connector of claim 1, further comprising a spring mechanically contacting the shaft and exerting a force on the shaft in a direction opposite the first direction.

6. The connector of claim 5, wherein a force exerted by the spring when the shaft is not being pressed against the receptacle causes the shaft to move in the direction opposite the first direction.

7. The connector of claim 1, wherein the power receptacle is a cigarette lighter receptacle in a vehicle.

8. The connector of claim 7, wherein the vehicle is selected from the group comprising: an automobile, boat, and a recreational vehicle.

9. The connector of claim 1, wherein the housing substantially surrounds the shaft.

10. A method of activating a power supply to deliver power from a power source, the method comprising:

inserting a connector of the power supply into a power receptacle so that a force is applied to a shaft of the connector;

in response to the force applied to the shaft of the connector, moving the shaft inward towards a body of the connector thereby causing a conducting finger of the connector to be moved from contact with an insulative portion of the shaft to contact a conductive portion of the shaft;

transferring power from the power receptacle to the shaft;

transferring power from the shaft to the conducting finger; and transferring power from the conducing finger to the power supply.

11. A method of disabling power delivered from a power source to a power supply, the method comprising:

engaging a connector portion of the power supply with a receptacle portion of the power source;

changing a position of the connector so that a conducting finger of the connector is moved from contact with a conductive portion of the connector to contact an insulative portion of the connector; and blocking transfer of power from the power source to the power supply due to the contact of the conducting finger with the insulative portion of the connector, wherein the changing a position of the connector is caused by movement of a vehicle in which the power source is located.

12. A method of reducing contact resistance between a power receptacle and a power supply connector, the method comprising:

inserting the power supply connector into the power receptacle so that a shaft of the power supply connector contacts a portion of the power receptacle;

engaging the power supply connector with the power receptacle so that the shaft is moved within the power supply connector; and creating an electrically conductive path through the power supply connector in response to movement of the shaft at least a predetermined distance within the power supply connector.

13. The method of claim 12, wherein the predetermined distance is sufficient to reduce contact resistance between the power receptacle and the power supply connector to a predetermined level.

14. The method of claim 12, wherein power receptacle is disposed in a vehicle.

* * * * *

UNITED STATES PATENT AND TRADEMARK OFFICE

CERTIFICATE OF CORRECTION

PATENT NO. : 7,108,528 B2
APPLICATION NO. : 10/984550
DATED : September 19, 2006
INVENTOR(S) : Wambsganss et al.

It is certified that error appears in the above-identified patent and that said Letters Patent is hereby corrected as shown below:

At column 1, line 24, after "appliances," insert -- stereo components, and computing device, for example, those devices typically include a --.

Signed and Sealed this

Tenth Day of April, 2007

JON W. DUDAS
*Director of the United States Patent and Trademark Office*